US005582117A

United States Patent [19]

Mendive et al.

[11] Patent Number: 5,582,117

[45] Date of Patent: Dec. 10, 1996

[54] FIREPOT WITH ASH-DUMPING FLOOR

[75] Inventors: Richard J. Mendive, Priest River; Dennis E. Needs, Laclede; Ronald J. Mendive, Coeur d'Alene, all of Id.

[73] Assignee: Mendive Needs Corporation, Priest River, Id.

[21] Appl. No.: 479,021

[22] Filed: Jun. 6, 1995

[51] Int. Cl.[6] ..... F23G 5/00

[52] U.S. Cl. ..... 110/247; 126/182; 110/259; 110/165 R

[58] Field of Search ..... 126/182; 110/247, 110/259, 165 R

[56] References Cited

U.S. PATENT DOCUMENTS

| | | | |
|---|---|---|---|
| 1,307,909 | 6/1919 | Leask | 110/259 |
| 1,957,583 | 5/1934 | Foresman | 110/165 R |
| 2,693,775 | 11/1954 | Berry | 110/165 R |
| 2,933,057 | 4/1960 | Wilson | 110/259 |
| 5,000,100 | 3/1991 | Mendive et al. | 110/250 |

FOREIGN PATENT DOCUMENTS

| | | | |
|---|---|---|---|
| 6241428 | 8/1994 | Japan | 110/259 |
| 1225748 | 3/1971 | United Kingdom | 110/259 |

*Primary Examiner*—Carroll B. Dority
*Attorney, Agent, or Firm*—Ken J. Pedersen; Barbara S. Pedersen

[57] ABSTRACT

Embodiments of a combustion firepot are shown and described, each having a means for dumping ashes and other burn debris from the firepot. The preferred embodiment is a pellet stove firepot with an interior ramped wall. Pellets are delivered to the firepot and directed by the ramp to rest and burn in a lower burn section on top of a movable floor. The movable ash-dumping floor is adapted to swing or slid away from the firepot to reveal an opening to permit ashes which have accumulated above it to be dumped out the bottom of the firepot. Preferably, when the heat demand for a room is satisfied, pellets are allowed to burn to ash, the floor is cycled open and closed to dump the ash, and then pellet delivery and burning is resumed. The dumping procedure may be done manually or automatically and either occasionally or periodically, depending on the demands placed on the system by the ash-producing tendency of the chosen fuel.

6 Claims, 5 Drawing Sheets

FIREPOT WITH ASH-DUMPING FLOOR

BACKGROUND OF THE INVENTION

1. Field of the Invention

This invention relates generally to pellet stoves and other combustion devices. More specifically, this invention relates to a pellet stove with a moveable, ash-dumping floor.

2. Related Art

U.S. Pat. No. 5,000,100 (Mendive et al.) discloses a pellet stove which has a pellet fuel container connected to a top-opening firepot via an auger. The firepot is generally cylindrical, with a cylindrical wall and a domed floor defining a combustion chamber. A plurality of air inlet passages extend through the cylindrical wall. Extending down from the combustion chamber floor is a ramped ignition chamber having a site for an ignitor near the bottom of the ramp.

The auger lifts fuel pellets from the fuel container to the top of a chute where they are dispersed in a controlled manner down into the inside of the firepot. The fuel pellets come to a rest and burn in the combustion chamber of the firepot and also in the ramped ignition chamber.

The bottom portion of the firepot supporting the ramp is removable so that ash from the pellets may be removed and the firepot may be cleaned. To dump the ashes, the firepot must be shut down, cooled enough to handle the bottom ramped portion, and kept shut down until the ramped portion is returned to its position in the firepot.

There is a desire in the fuel pellet business to burn fuel pellets with higher ash content. This way, less expensive sources of fuel pellets may be made available. However, the higher ash content of these pellets requires more ash removal, with increased removal costs and inconveniences. Therefore, there is a need for better pellet stove equipment with increased ash removal capabilities.

SUMMARY OF THE INVENTION

A primary object of the present invention is to provide a pellet stove or other combustion device with improved ash-removal capability. It is also an object of the present invention to provide a stove or a firepot for a stove that has either manual or automatic ash-dumping equipment that is simple, reliable, economical, and easily maintained.

The present invention comprises a pellet stove firepot with a moveable, ash-dumping floor. The firepot has a steep side or sides near its bottom so that the fuel pellets are directed by gravity to a burn section on the floor of the firepot. Also near the floor of the firepot, there is a site for an ignitor assembly and an ignition air inlet. Thus, the fuel pellets fall down to the burn section, are ignited, and burn to ash while resting on the firepot floor. Preferably, the steep side of the firepot slants from a larger-diameter upper section of the combustion chamber to a smaller-diameter or smaller-width burn region. These dimensions serve to concentrate the few pellets that burn at a given time into a fairly compact space, close to the ignition assembly and directly above the movable firepot floor.

The movable firepot floor may be swung or slid away from the firepot to permit ashes which have accumulated above it to be dumped out of the bottom of the firepot. Preferably, the dumping cycle is timed so that, when the heat demand of the room is satisfied, pellet delivery to the combustion chamber is temporarily halted, the pellets already inside the firepot are burned to ash, and the firepot floor is then opened to dump out the ash from the combustion chamber. The ash-dumping floor may be opened manually or automatically and either occasionally or periodically, depending on the ash production of the fuel being used.

DESCRIPTION OF THE PREFERRED EMBODIMENTS

Figure 1:
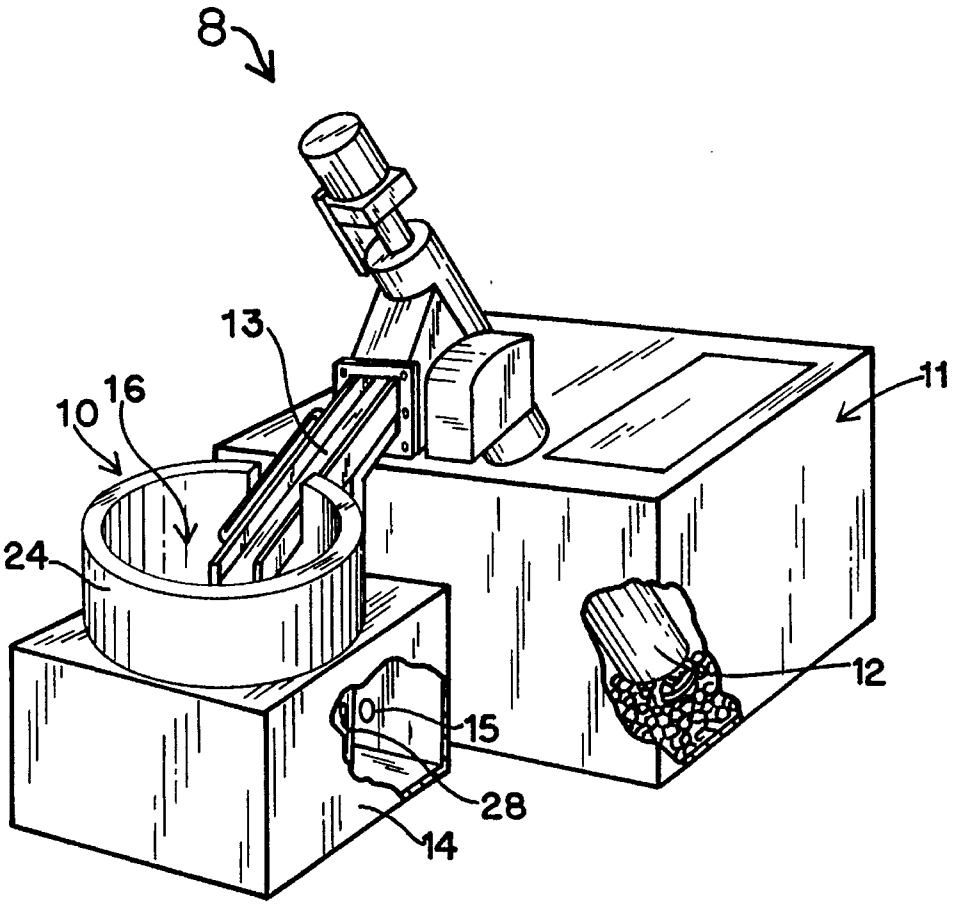
FIG. 1 is a perspective view of one embodiment of a pellet stove which includes the firepot of the present invention.
Figure 3:
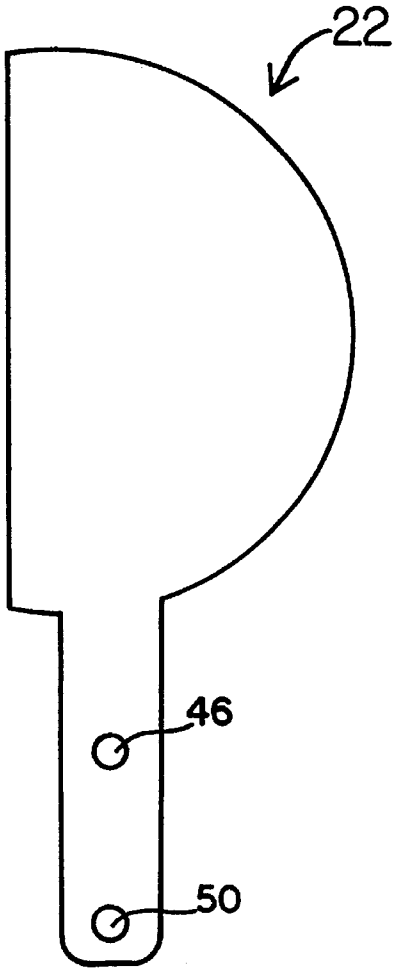
FIG. 3 is a top view of the embodiment of the moveable floor member of FIG. 2.

Referring to the Figures, there is depicted one, but not the only, embodiment of the invented firepot 10. FIG. 1 depicts a pellet stove 8, which includes firepot 10, pellet fuel container 11, auger 12 and feed chute 13. The bottom portion of firepot 10 is surrounded by plenum 14 which contains air passages 15 for an optional blower for providing additional oxygen to the firepot.

The firepot 10 comprises a container 17 surrounding the combustion chamber 16. The container 17 is generally defined by the sidewall 18, which includes ramp 20, and the floor 22 at the bottom end 23 of the container 17. The sidewall upper portion 24 is generally cylindrical, but the sidewall 18 transitions near its middle to create the ramp 20 on one side of the firepot 10. Thus, the ramp 20 slants down to generally the bottom middle of the combustion chamber 16, so that its lower end 26 is near the floor 22. Preferably, ramp 20 has a generally flat upper surface.

Air holes 28 extend through the sidewall 18 at various locations, preferably spaced around the sidewall circumference from near the top to near the bottom of the combustion chamber, including through the ramp 20. The air holes 28 nearer the top of the combustion chamber preferably lie at an angle to create a vortex air flow inside the combustion chamber.

Once pellets 29 are delivered to the burn section 30, pellet combustion is started by ignitor assembly 32, which lights or re-lights the pellets 29 both by radiation from the ignitor and by hot ignition air which flows past the ignitor, through the ignition air inlet 34, and across the pellets 29. Typically, only a few pellets 29 are burned at a given time, with small additions of pellets being delivered by the auger 12 and feed chute 13 as needed.

When ash 35 builds up in the burn section 30 on the top of moveable floor 22, the floor 22 is moved to permit the ashes and any other burn debris resting on top of it to be dumped out of the bottom of firepot 10. The floor 22 is generally horizontal and pivotable away from the firepot 10 in a horizontal plane. Pivoting the floor 22 away from the firepot 10 reveals an opening 36 in the bottom portion of the combustion chamber 16. The preferred movable floor 22 extends across the entire distance from the ramp lower end 26 to the opposite sidewall 38, so that when the floor 22 is moved aside, the ashes fall efficiently and completely out of the firepot 10. The preferred ramp 20 and opposite sidewall 38 are shaped to make the opening 36 a semi-circular shape and, therefore, the preferred floor 22 is also a semi-circular shape.

Figure 2:
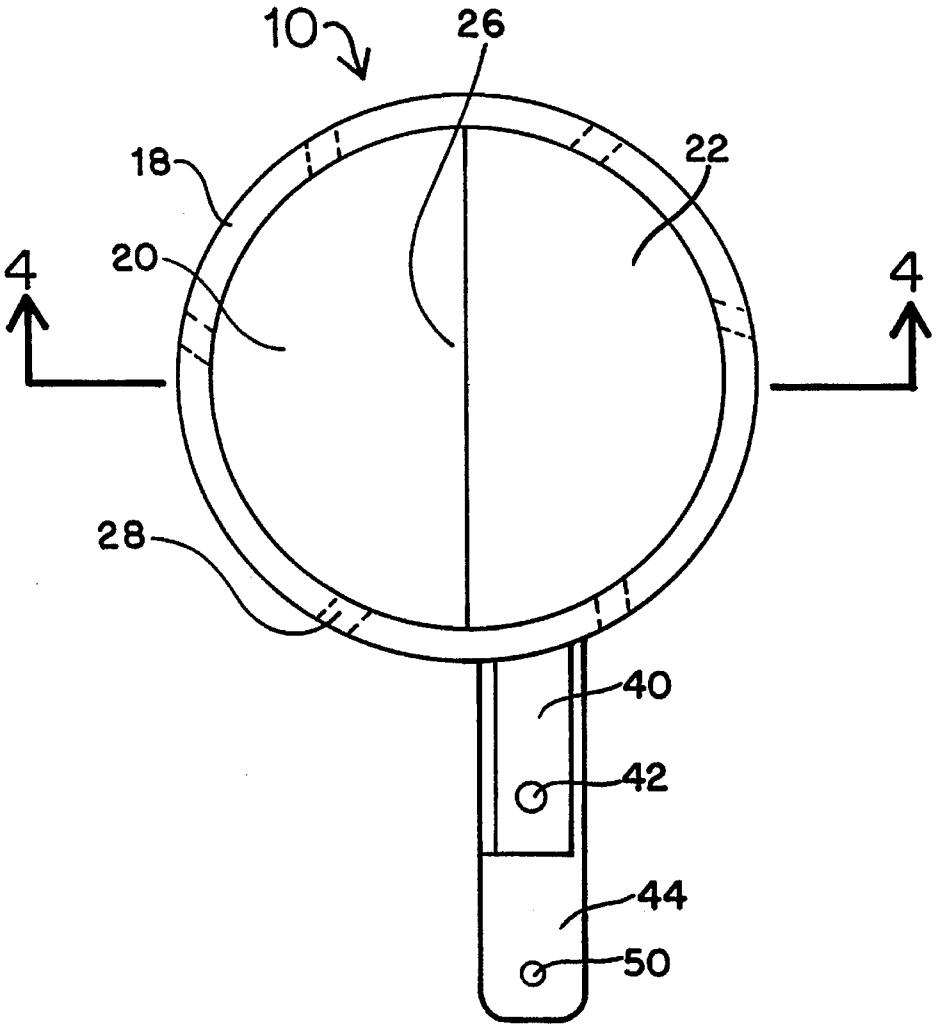
FIG. 2 is a top, partial detailed view of an embodiment of the firepot of the present invention, with the movable floor in the closed position.
Figure 4:
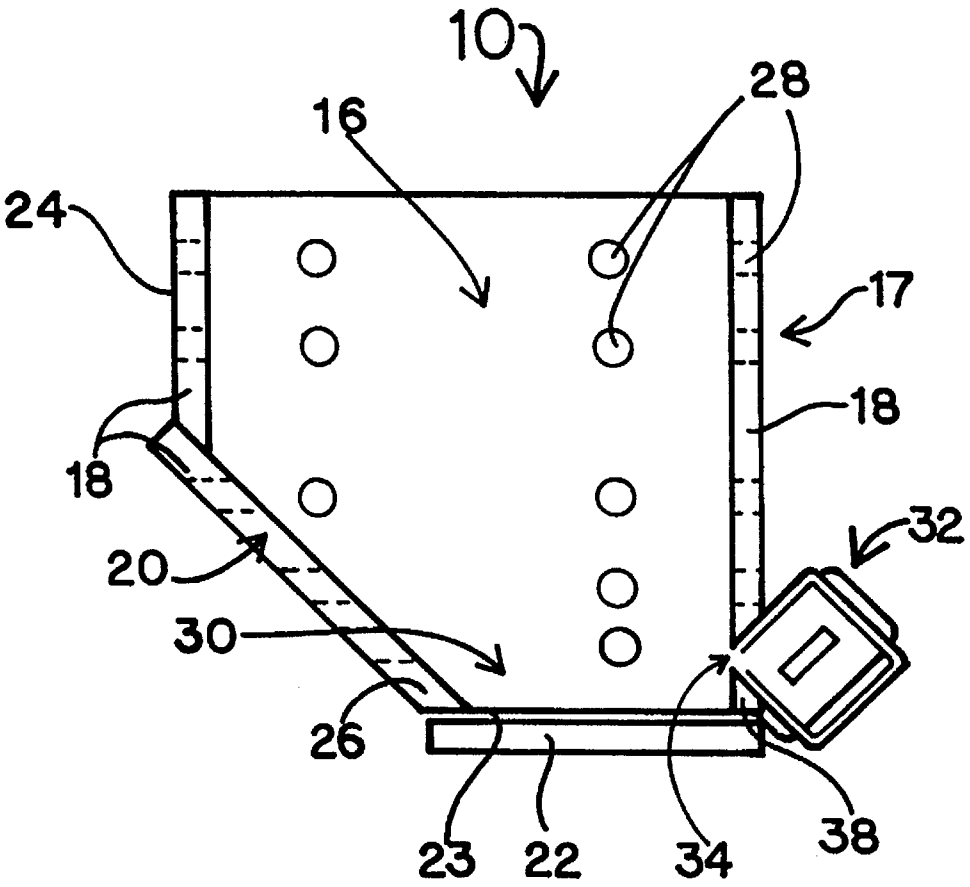
FIG. 4 is side, cross-sectional view of the embodiment of the firepot of FIG. 2, viewed along the line 4—4 in FIG. 2.
Figure 5:
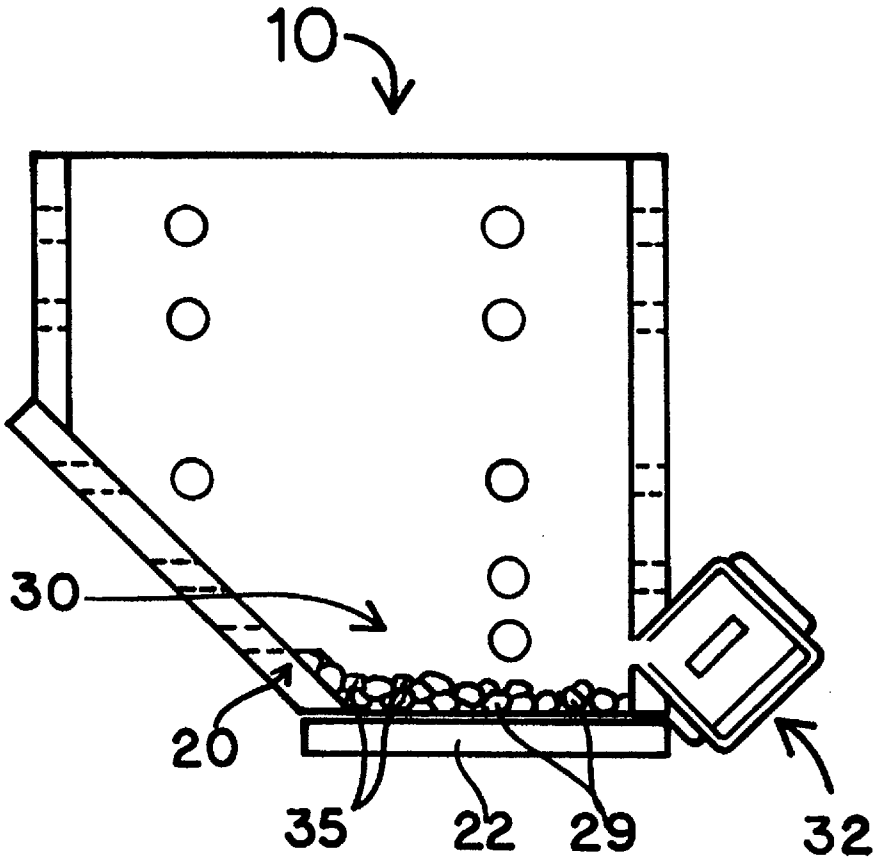
FIG. 5 is a side, cross-sectional view as in FIG. 4, shown with pellets and ash in the burn section.
Figure 6:
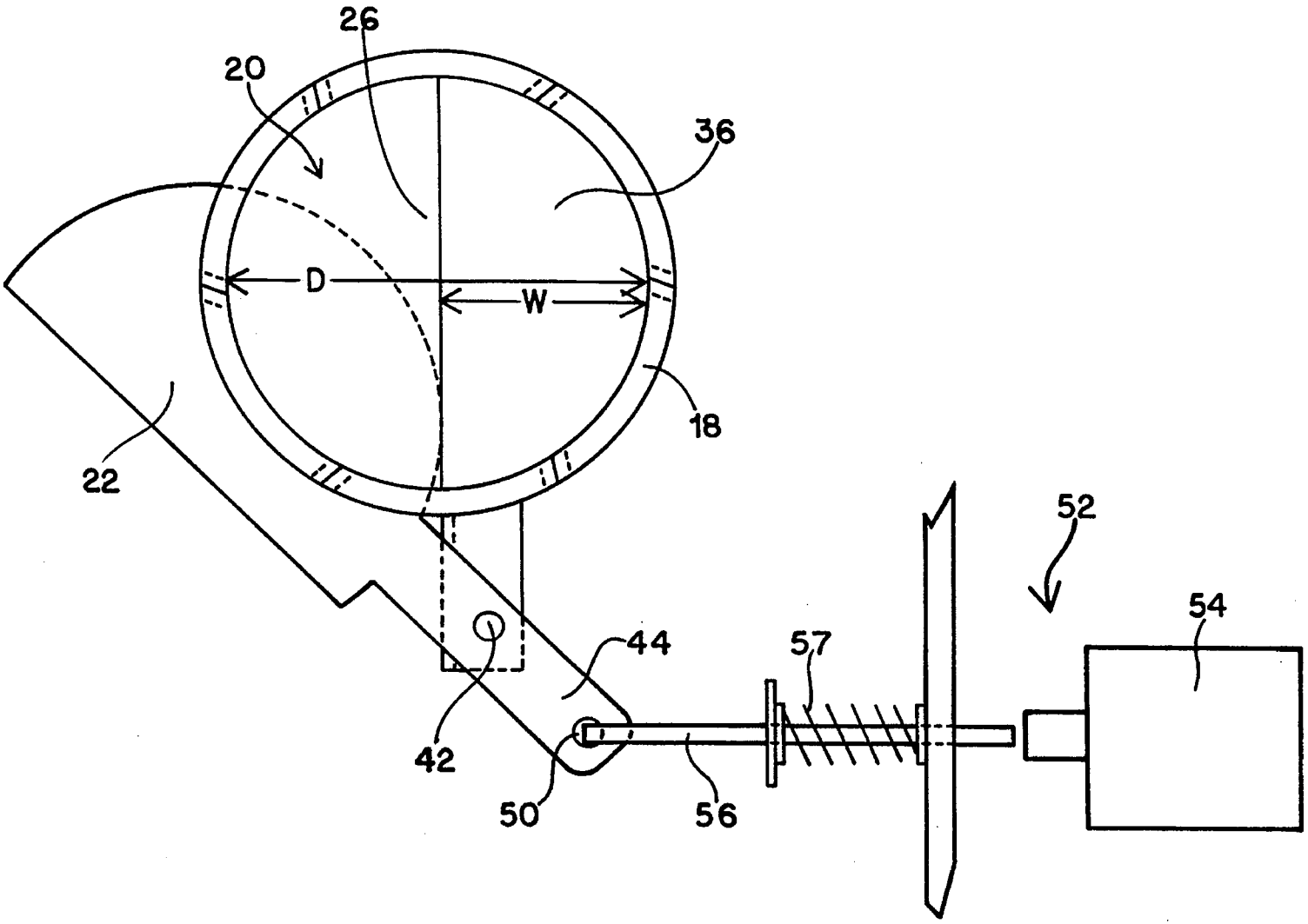
FIG. 6 is top, partial view of the firepot embodiment of FIG. 2, with the floor member connected to and controlled by an electric solenoid, and the floor member being in the open position.

FIG. 2 shows an attachment member 40 extending out from the sidewall 18 for pivotable attachment of the floor 22 to the firepot 10. In the embodiment of FIG. 2, this attachment member 40 takes the form of an L-shaped bracket having a pivot point 42 or hole. The floor 22 has an extending arm 44 and a floor pivot point 46. When the floor 22 is pivotally connected to the attachment member 40 at the pivot points 42, 46, the floor 22 may then be rotated or pivoted in a horizontal plane to create the opening 36 in the bottom of firepot 10. Preferably, floor 22 has an extending arm 44, on which the floor pivot point 46 is located and on which a linkage attachment point 50 is also located. The linkage attachment point 50 is for connecting movable floor 22 to an automatic means for moving the floor, for example, to a solenoid assembly 52. As shown in FIG. 6, movement of the floor 22 may be effected automatically by connecting linkage attachment point 50 to an electric solenoid 54 by connecting rod 56 and spring 57.

In operation, the stove 8 typically produces heat for a room or space by the careful metering and burning of small numbers of fuel pellets 29 at a given time. As described above and in the well-known art, pellets are preferably delivered to an open-top firepot. The invented firepot 10 with its slanted ramp 20 directs the pellets 29, as they fall, from the larger, upper portion of the combustion chamber 16 to the smaller, lower burn section 30 of the combustion chamber 16. In this burn section 30, the pellets 29 are ignited by the ignition assembly 32 or by the other burning pellets 29.

Air flow around and through the pellets 29 is optimized by the many air holes 28 and by the vortex air flow which circulates around the combustion chamber 16 to effectively contact and supply the pellets with combustion air. The configuration of the invented firepot 10, which transitions gradually and moderately from the larger sidewall upper portion 24 with air holes 28 to its narrower, but not cramped or isolated burn section 30 at the bottom end 23, creates excellent air circulation and a burn section 30 without any dead or low-air-flow areas. In addition, having air holes 28 in the ramp 20 contributes to excellent air circulation and supply. Thus, the location of the pellets is controlled by the ramp directing the pellets to the smaller burn section and close to the ignitor assembly 32 and the burn conditions are controlled by the configuration and resulting air flow in the combustion chamber.

The configuration of the container 17 and sidewall 18 is partly determined by the relative dimensions of the sidewall upper portion 24 and the bottom end 23 of the container 17. Preferably the upper diameter (D) of the container 17, that is, the diameter across the upper portion 24 of the sidewall, is about twice as great a distance as the width (W) of the opening 36 in the bottom end 23. Alternatively, the upper diameter may preferably be in a range of about 1.5–2.5 times the width (W) of the opening 36.

When the heat demand for the room or space is satisfied, the pellet delivery system stops, and the pellets 29 already burning in the burn section 30 are allowed to burn to ash 35, typically over a time period of about 8–12 minutes with an exhaust or inlet air blower on to continue efficient exhaust and to cool the ash. The floor 22 then opens and dumps out the ash, preferably into a tray or other removable receptacle (not shown) below the firepot 10. Some ash and clinkers may tend to stick on the ramp 20 until the vibration of the first or repeated cycles of the moving floor knocks them loose. Therefore, preferably, the floor opens and closes twice, the first time being for removal of the bulk of the ash, and the second time being for removal of residual ash or clinkers that were held or lodged in the combustion chamber and then jarred loose by the first opening and closing of the floor.

Once the floor 22 has cycled open and closed the desired number of times and the floor 22 is closed, the pellet delivery, ignition and burning is resumed. Conventional modes of control may be used for the efficient and safe cycling and operation of the stove, including temperature control, sequencing, number of floor 22 openings, pellet delivery control, and safety controls.

Preferably, the time it takes for the floor 22 to open and close each time is about 4–5 seconds, and the distance the floor 22 moves horizontally is about 1⅜ inches at attachment point 50. Thus, a conventional solenoid system can easily and quickly handle the job of opening and closing the floor. Also, the travel of the conventional solenoid system can easily move the wide part of the preferred floor 22 to the side about 4½ inches so that it moves away from the opening 36.

The cycling time (i.e. the time to open and close the floor 22 once or several times in quick succession) may be adjusted and controlled by various means, including visual inspection and manual cycling of the floor 22 or by automatic cycling of the floor 22 based on setpoints programmed into an automatic control system. Alternatively, other automatic means for moving the floor 22 may be used, including a motorized worm gear, or hydraulic ram, for example, or a manually operated handle may also be used.

Alternatively, other configurations of combustion chamber may be used with a movable ash-dumping floor. For example, a plurality of movable floor sections could be used, or the floor could be a different shape besides the semi-circular floor 22. The preferred pivoting, flat, horizontal floor makes a simple, efficient design, however, the invention also includes other shapes of movable floors and openings and movable floors that move in other ways than horizontally.

Although this invention has been described above with reference to particular means, materials and embodiments, it is to be understood that the invention is not limited to these disclosed particulars, but extends instead to all equivalents within the scope of the following claims.

What is claimed is:

1. A pellet stove firepot comprising:

a container for receiving fuel pellets, said container having a sidewall, with an upper portion having a diameter or width, and a bottom end;

an inclined portion of said sidewall, said inclined portion slanting down from the upper portion of the container and terminating at the inclined portion's lower end close to said bottom end of said container to create a burn region at said bottom end with a diameter or width smaller than the diameter or width of the upper portion of the container;

an ignitor assembly located close to said bottom end of said container, said ignitor also being located in close proximity to said lower end of said inclined portion of said side wall;

a movable floor of said container, said floor being located near the container bottom end;

means connected to said floor for moving the floor in order to create an opening in said bottom end of said container; and wherein said sidewall, and said inclined portion of said sidewall, has a plurality of air holes extending therethrough.

2. A firepot as set forth in claim 1, wherein the floor is generally horizontal and is moveable in a horizontal direction to create the said opening.

3. A firepot as set forth in claim 1, wherein the said floor and the said opening are generally semi-circular in shape.

4. A firepot as set forth in claim 1, wherein the said inclined portion of said sidewall is a generally flat ramp extending from the upper portion of the sidewall to the said floor.

5. A firepot as set forth in claim 1, wherein the said container has an upper diameter at the said sidewall upper portion and a bottom width at the said bottom end, wherein the said upper diameter is about 1.5–2 times as large as the bottom width.

6. A firepot as set forth in claim 1, wherein the ignitor is located in the sidewall above said floor.

* * * * *